United States Patent [19]

Smith

[11] Patent Number: 4,867,030

[45] Date of Patent: Sep. 19, 1989

[54] BRIDGE FOR STRINGED INSTRUMENTS

[76] Inventor: Walter E. Smith, 10716 W. Cruser St., Boise, Id. 83709

[21] Appl. No.: 274,356

[22] Filed: Nov. 21, 1988

[51] Int. Cl.[4] ..... G10D 3/04

[52] U.S. Cl. ..... 84/299; 84/307

[58] Field of Search ..... 84/209, 298, 299, 307, 84/308, 309

[56] References Cited

U.S. PATENT DOCUMENTS

| | | | |
|---|---|---|---|
| 82,928 | 10/1868 | DeVine | 84/209 |
| 551,450 | 12/1895 | Renner | 84/307 |
| 558,619 | 4/1896 | Stebbins | 84/307 |
| 642,416 | 1/1900 | Beetem | 84/309 |
| 1,096,812 | 5/1914 | Doyle | 84/309 |
| 1,362,847 | 12/1920 | Champagne | 84/309 |
| 1,510,982 | 10/1924 | Dennis | 84/309 |
| 3,174,380 | 3/1965 | Cookerly et al. | 84/307 |
| 3,457,819 | 7/1969 | Vagias | 84/209 |
| 4,696,219 | 9/1987 | Plescia | 84/314 N |
| 4,768,414 | 9/1988 | Wheelwright | 84/298 |

FOREIGN PATENT DOCUMENTS

| | | | |
|---|---|---|---|
| 1363 | 9/1857 | United Kingdom | 84/209 |

*Primary Examiner*—Lawrence R. Franklin

*Attorney, Agent, or Firm*—Paul F. Horton

[57] ABSTRACT

A bridge for stringed instruments including a base member and a saddle member affixed thereto. The saddle is constructed of two or more adjacent, discrete, and homogeneous units of differing material, each of which are in contact with selected strings of the instrument to provide desired sound characteristics upon activation of the strings. A variety of sounds of varying timbre and sustain may thereby be provided. Contact of selected units with the base member also provides varying sound characteristics. The units of differing substances may be in laminated form or may be in the form of discrete rods placed in a common body portion of the saddle. In the use of rods in a common body, the rods may be grooved to receive the string or the string may be strung so as to contact the side of the rod.

10 Claims, 1 Drawing Sheet

BRIDGE FOR STRINGED INSTRUMENTS

BACKGROUND OF THE INVENTION

1. Field of the Invention

This invention relates in general to stringed instruments; particularly to bridges for stringed instruments; and even more particularly to bridge saddles.

2. Description of the Prior Art

Creators of musical instruments are continually attempting to improve the acoustic qualities of the instruments to obtain "richer" and "fuller" sounds. With stringed instruments, emphasis has been primarily placed on the characteristics of the strings; the resonator or soundboard and pickups for electric guitars. Bridges, used to maintain strings in place above the soundboard, have been made adjustable, as shown by T. J. McHugh et al, U.S. Pat. No. 1,365,839, and though generally constructed of wood, steel, or plastic, have included saddles constructed of ceramics to provide long life and improve tonal clarity, as shown by T. S. Eizonas, U.S. Pat. No. 4,308,784. Also, it has been found that bridge pins, used to secure the ends of strings to the bridge, when constructed of heavy metal, such as brass, increase the presence and sustain of the instrument, as shown by M. R. Holman, U.S. Pat. No. 4,197,779. All known bridge saddles are composed of a single material such as wood, metal, ceramic, and the like.

The inventor of the present invention has found that by constructing the bridge saddle of at least two distinct, adjacent, and homogeneous units of differing materials, each in contact with a respective string of the instrument, that the string-saddle combination produces a special timbre and that by using such differing materials with separate strings of the instrument one can produce a rich blend of sounds to make each stringed instrument unique in its sound characteristics. For example, a B-string contacting a saddle constructed of adjacent units of steel and brass will have a noticeably different timbre than the same B-string contacting a saddle constructed of elm wood and ceramic. Even saddles composed of two distinct types of wood, such as oak and ash, will produce a different timbre than beech and maple, for example. While the production of sound of differing timbre in stringed instruments is complex, it is known that materials of differing densities conduct sound at varying velocities and it may be that this characteristic is of vital importance in the saddle's interaction with the strings.

SUMMARY OF THE INVENTION

The present invention comprises, generally, a bridge for a stringed musical instrument, having a base member and a saddle member; the saddle member constructed of at least two discrete and adjacent units of homogenous material, each of the units contacting a string to produce sounds of varying timbre and sustain dependent upon the characteristics of the materials.

It is therefore a primary object of the present invention to provide a bridge having a base member and a saddle member; the saddle member constructed of at least two differing materials in contact with a string to impart a unique sound upon activation of the string.

It is also an object of the present invention to provide a bridge having a saddle member constructed of a laminate of at least two differing materials.

Another object of the present invention is to provide a bridge having a saddle member including a body portion of one material and one or more rod-like inserts of a differing material.

Even more particularly, it is an object of the present invention to provide a bridge having a saddle member having a body portion of one material and inserts of a differing material, each in contact with one or more strings of a musical instrument, wherein selected inserts terminate within the body portion and selected inserts terminate in contact with the base of the bridge.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
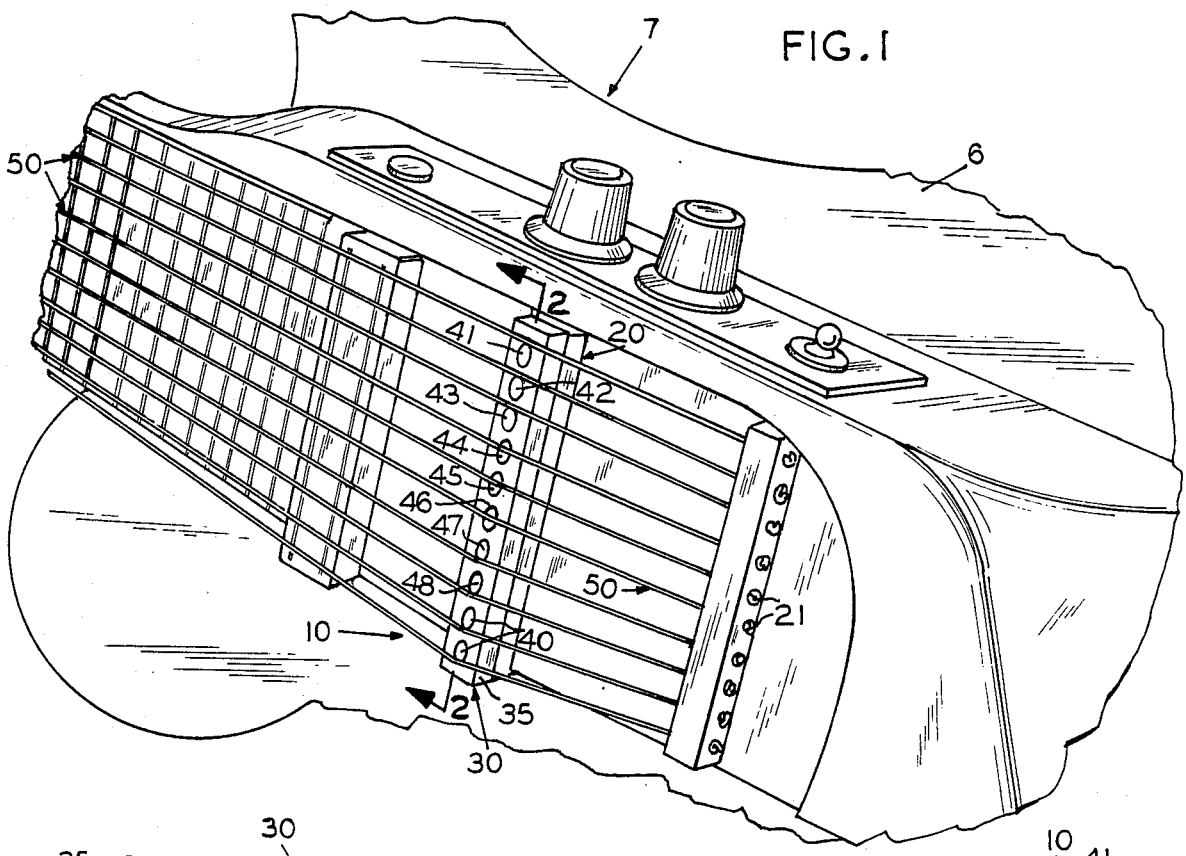
FIG. 1 is a perspective view of a bridge mounted to the body of a stringed instrument, showing one embodiment of the present invention.
Figure 2:
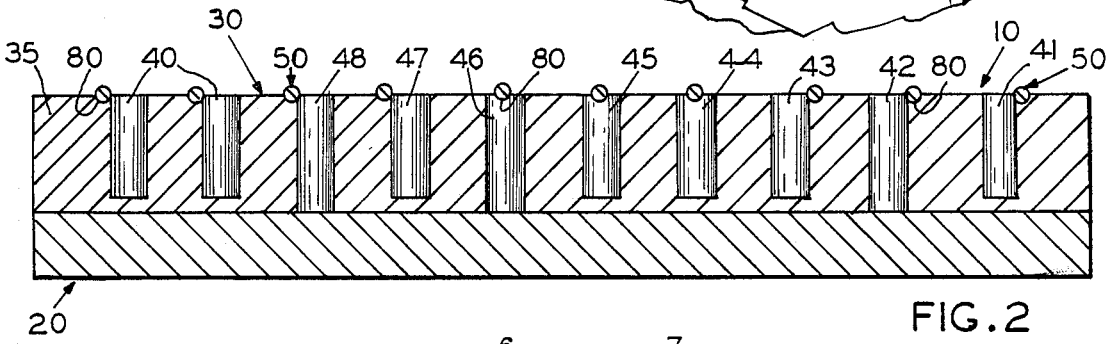
FIG. 2 is a sectional view taken along lines 2—2 of FIG. 1.

Referring now to the drawings, and, more particularly to FIGS. 1 and 2, a first embodiment to be preferred of bridge 10 for stringed instruments is disclosed. Bridge 10 includes, generally, a base member 20 and a saddle member 30 affixed to the base member for supporting strings 50.

Base member 20 of bridge 10 engages and is affixed to the top surface of body 6 of a stringed instrument such as steel guitar 7. The base member may be constructed of any suitable material, such as steel, wood, plastic, ceramic, or the like, and may be unitary with body portion 35 of saddle 30. Adjacent its rearwardmost terminal end, the base member may be provided with a series of apertures 21 for receiving the ball ends of strings 50. The base member may be of any suitable size and construction, depending upon the nature of the instrument and may be generally defined as that portion of the bridge located between the saddle and the body of the instrument.

Saddle 30 includes, as a first unit, an elongated body portion 35 in the form of a raised ridge extending across the bridge, and a selected number of rod-like units, designated generally by the numeral 40, mounted within the body portion. Units 40 may be affixed to the body portion of saddle 30 by any suitable adhesive or may threadably engage the body portion for convenient replacement, when desired. Units 40 are constructed of discrete and homogeneous materials differing from the material from which the body portion 35 of the saddle is constructed. For example, body portion 35 may be constructed of steel and each unit of units 40 may be constructed of an identical material, such as ash wood or, if desired, units 40 may each be constructed of differing materials. Unit 41, for example, may be constructed of ceramic; unit 42 of elm; unit 43 of oak; unit 44 of brass, etc. Where body portion 35 differs in composition from base member 20, as, for example, where the base member is constructed of steel and body portion 35 of ceramic, it has been found that sounds of differing timbre may be produced, even though units 40 are each constructed of identical materials, depending upon whether the units 40 terminate within the body portion 35, as illustrated by units 43, 45, and 47 or whether the units make contact with base member 20 as illustrated by units 42, 46, and 48.

In order for the strings 50, when activated, to cooperate with the body portion 35 and units 40 of the saddle to produce the unique sounds, the strings must engage both. As shown to advantage in FIG. 2, the body portion 35 includes grooves 80 to receive the strings. Units 40 may also be grooved, as illustrated by units 44, 45, and 46, or, in the alternative, the strings may be caused to engage the side of the unit as illustrated by units 42, 43, and 47.

Figure 3:
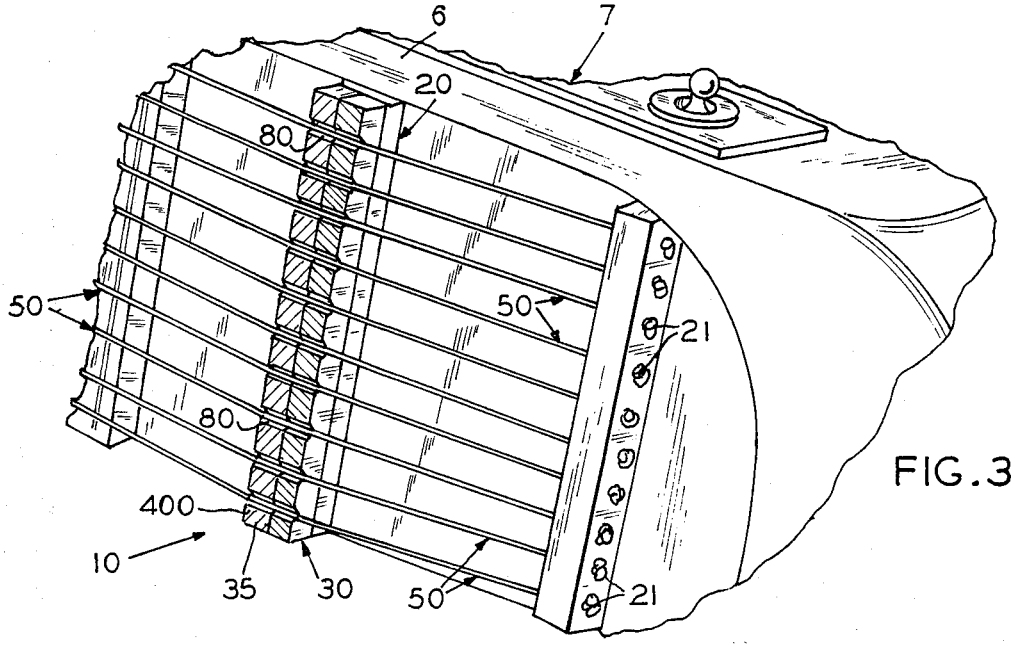
FIG. 3 is a perspective view of a second embodiment of the present invention.

Referring now to FIG. 3, another embodiment of bridge 10 of the present invention may be seen. In this embodiment, the base member 20 may be the same as the base member shown in the first embodiment; the difference being solely in saddle member 30. Saddle member 30 includes, as a first unit, body portion 35, which may be unitary with the base member, being constructed of one discrete and homogeneous material, such as steel, and one or more other units 400 which lie adjacent to and parallel with the body portion on the same horizontal plane, preferably in laminated configuration, as shown in the figure. While FIG. 3 shows only a single laminate 400 adjacent body portion 35, it will be understood that any number of units 400 may be placed adjacent one another and the body portion. The body portion and all units 400 are provided with grooves 80 for retaining strings 50 of the instrument. As an example of this embodiment, body portion 35 may be constructed of wood, such as elm, and units 400 may be constructed of selected metals such as brass, steel, aluminum, etc., ceramic, other woods, or any of a large number of suitable materials.

Where adjustable bridges, not shown, are used, each string includes its own separate, longitudinally movable, saddle member unit. It is contemplated that each individual unit may be constructed of a material differing from other saddle member units and therefore such units are to be considered as a "unit" of a "saddle member" within the meaning of the appended claims.

Having thus described in detail preferred embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A bridge for guitars comprising:

a horizontally oriented base member affixed to the top of the guitar; and a raised saddle member affixed to said base member, said saddle member being constructed of at least two adjacent, discrete, and homogeneous units of differing materials, at least one of which is metal, each unit engaging a string of said guitar to produce a sound of unique timbre upon activation of the string.

2. The bridge as described in claim 1 wherein said saddle member includes a first unit of one material and at least one other unit of differing material adjacent to and parallel with said first unit.

3. The bridge as described in claim 2 wherein said units are in laminated orientation relative to one another.

4. The bridge as described in claim 2 wherein said first unit is constructed of wood.

5. The bridge as described in claim 1 wherein said saddle member includes a first unit defining an elongated body portion and further including a selected number of other insert units, mounted within said body portion.

6. The bridge as described in claim 5 wherein selected insert units are each provided with a groove through which selected strings of said guitar are strung.

7. The bridge as described in claim 5 wherein said insert units are rod-like in form.

8. The bridge as described in claim 5 wherein a selected number of said insert units are in physical contact with said base member of said bridge.

9. A bridge for guitars comprising:

a horizontally oriented base member affixed to the top of the guitar; and a saddle member, said saddle member being constructed of a body portion of one material and at least one or more laminates, each of said laminates composed of a differing material, at least one of which is metal, and said body portion and each of said laminates provided with one or more aligned grooves for receiving respective strings of said guitar.

10. The bridge as described in claim 9 wherein said body portion of said saddle member and said base member are of unitary construction.

* * * * *